US011835218B1

(12) United States Patent
Liao et al.

(10) Patent No.: US 11,835,218 B1
(45) Date of Patent: Dec. 5, 2023

(54) FAN WITH MULTIPLE LIGHT RINGS

(71) Applicant: HuiZhou Fly Upwards Electron Co., Ltd., Guangdong (CN)

(72) Inventors: Yonghong Liao, Guangdong (CN); Xinqiang Zhang, Guangdong (CN)

(73) Assignee: HuiZhou Fly Upwards Electron Co., Ltd., Guangdong (CN)

( * ) Notice: Subject to any disclaimer, the term of this patent is extended or adjusted under 35 U.S.C. 154(b) by 0 days.

(21) Appl. No.: 18/319,470

(22) Filed: May 17, 2023

(30) Foreign Application Priority Data

Nov. 30, 2022 (CN) ..... 202223180786.9

(51) Int. Cl.

| | |
|---|---|
| ***F21V 33/00*** | (2006.01) |
| ***F21V 3/06*** | (2018.01) |
| ***F04D 29/52*** | (2006.01) |
| ***F04D 25/06*** | (2006.01) |
| *F21Y 103/33* | (2016.01) |

(52) U.S. Cl.
CPC ..... *F21V 33/0096* (2013.01); *F04D 25/06* (2013.01); *F04D 29/522* (2013.01); *F21V 3/062* (2018.02); *F21Y 2103/33* (2016.08)

(58) Field of Classification Search
CPC ..... F21V 33/0096; F21V 33/0088; F21V 33/0092; F21Y 2103/33
See application file for complete search history.

(56) References Cited

U.S. PATENT DOCUMENTS

2019/0249862 A1* 8/2019 Fan ..... G06F 1/181

* cited by examiner

*Primary Examiner* — Sean P Gramling
(74) *Attorney, Agent, or Firm* — JCIPRNET

(57) ABSTRACT

A fan with multiple light rings according to the present disclosure, by means of the setting of the specific structure of the lower fan frame cover, the light guide frame, and the upper fan frame cover, with the shading cover and the outer light source ring, using a light guide frame to guide the light emitted by the outer light source ring, which can form three light rings on the inner side, outer side and upper side of the fan frame.

6 Claims, 3 Drawing Sheets

FAN WITH MULTIPLE LIGHT RINGS

CROSS-REFERENCE TO RELATED APPLICATION

The present application claims priority of Chinese Patent Application No. 202223180786.9, filed on Nov. 30, 2022, the entire contents of which are hereby incorporated by reference.

BACKGROUND

Technical Field

The present application relates to the field of fans, in particular to a fan with multiple light rings.

Description of Related Art

With the development of science and technology, electronic products are becoming more and more common. Electronic products heat up during use, so fans are usually used to dissipate heat. In order to attract the attention of consumers and improve the decorative effect, many fans are designed with light rings. However, the existing fans with light ring usually cannot achieve the lateral light effect, such that the effect is not so good when used. Moreover, because the light ring is usually set independently, there are more related parts, resulting in more troublesome fan assembly. Therefore, it is necessary to improve the existing technology to provide a fan with multiple light rings.

SUMMARY

Based on this, it is necessary to provide a fan with multiple light rings against the current problems.

A fan with multiple light rings according to the present disclosure, comprising a lower fan frame cover, a light guide frame, an upper fan frame cover, fan blades, a shading cover and an outer light source ring;

the lower fan frame cover comprising a first vertical portion, a first horizontal portion and a central mounting seat located inside the first vertical portion, the fan blades being disposed on the central mounting seat;

the light guide frame comprising an upper horizontal portion and a second vertical portion disposed on an outer side of the upper horizontal portion, an inner light guide portion being disposed on an inner side of the upper horizontal portion, an upper light guide portion being disposed on an upper side of the upper horizontal portion, an outer light guide portion being disposed at a lower end of the second vertical portion, the second vertical portion being disposed outside the first vertical portion, the inner light guide portion abutting on an upper end of the first vertical portion, the shading cover abutting with a portion between the inner light guide portion and the upper light guide portion, and the outer light guide portion abutting on an upper surface of the first horizontal portion;

the upper fan frame cover comprising a second horizontal portion and a third vertical portion, the second horizontal portion abutting with a portion between the upper light guide portion and the upper horizontal portion, the third vertical portion being disposed outside the second vertical portion, and a lower end of the third vertical portion abutting on an upper surface of the outer light guide portion;

the outer light source ring being disposed between the lower fan frame cover and the light guide frame, and the lower fan frame cover, the light guide frame and the upper fan frame cover fit together to form three light rings.

In one of the embodiments, a motor and a central light source ring are disposed on an upper surface of the central mounting seat; an output shaft of the motor is connected with a light guide cover, and the light guide cover covers the motor and the central light source ring; at least part of an upper surface of the light guide cover is covered by a nameplate; and the fan blades are disposed around the light guide cover.

In one of the embodiments, the central light source ring comprises an annular substrate and a plurality of first light sources disposed on the annular substrate at equal intervals.

In one of the embodiments, the outer light source ring comprises an annular strip and a plurality of second light sources disposed on the annular strip at equal intervals.

In one of the embodiments, a support portion for supporting the outer light source ring is disposed on an outer side of the first vertical portion.

In one of the embodiments, the shading cover is fixed to the inner light guide by means of snap fit.

A fan with multiple light rings according to the present disclosure, by means of the setting of the specific structure of the lower fan frame cover, the light guide frame, and the upper fan frame cover, with the shading cover and the outer light source ring, using a light guide frame to guide the light emitted by the outer light source ring, which can form three light rings on the inner side, outer side and upper side of the fan frame, so as to obtain the luminous effect of multiple light rings, so that the luminous effect of the fan is more attractive, and the structure is simple and the assembly is convenient.

DESCRIPTION OF THE EMBODIMENTS

In order to make the above purpose, features and advantages of the present disclosure more obvious and easier to understand, the specific embodiments of the present disclosure will be described in detail in the following in conjunction with the accompanying drawings. In the following description, many specific details are elaborated in order to fully understand the present disclosure. However, the present disclosure may be implemented in many other ways different from those described herein, and those skilled in the art may make similar improvements without violating the content of the present disclosure, so the present disclosure is not limited by the specific embodiments disclosed below.

It should be noted that when a component is said to be "fixed" to another component, it can be directly on top of another component or other components can exist in between. When a component is considered to be "connected" to another component, it can be directly connected to another component or other components can exist in between at the same time. Conversely, when a component is described as "directly on" another component, there is no intermediate component. As used herein, the terms "vertical", "horizontal", "left", "right", "one side", "another side", "one end", "another end" and similar expressions are for illustrative purposes only and are not limitations on the specific orientation of components in the product or device.

Unless otherwise defined, all technical and scientific terms used herein have the same meaning as those normally understood by those skilled in the technical art of the present disclosure. The terms used in the specification of the present disclosure herein are only for the purpose of describing specific embodiments, and are not intended to limit the present disclosure. As used herein, the terms "and/or" include any and all combinations of one or more related items listed.

Figure 1:
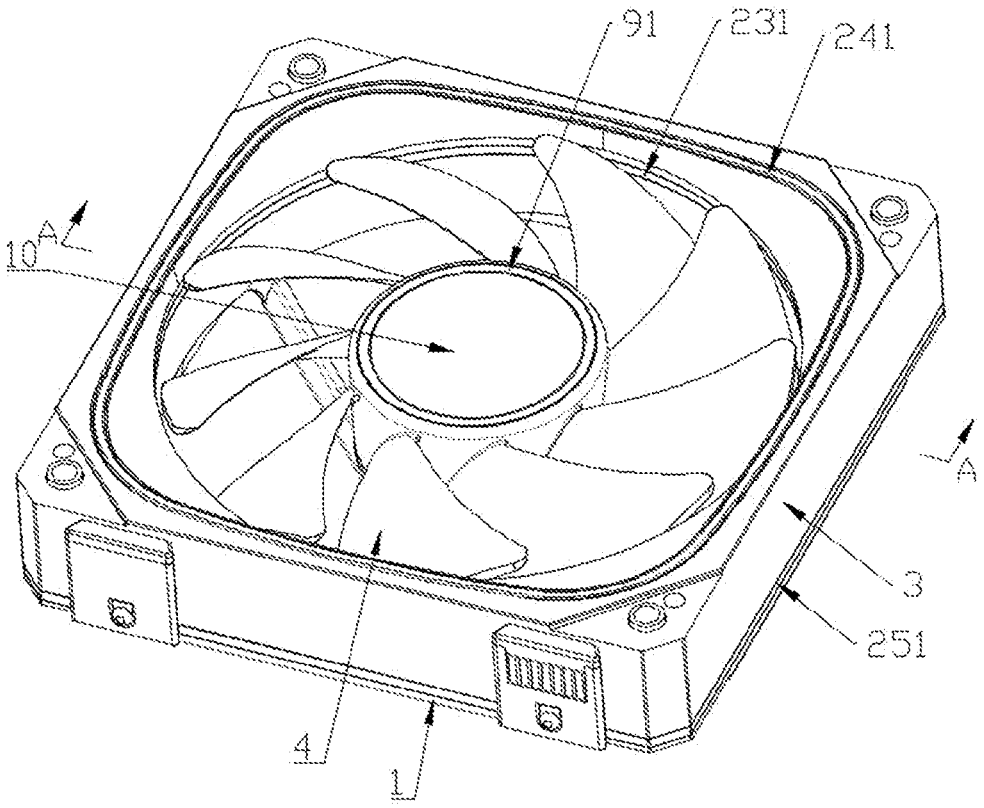
FIG. 1 is a schematic diagram of three-dimensional structure of the fan with multiple light rings according to the present disclosure.
Figure 2:
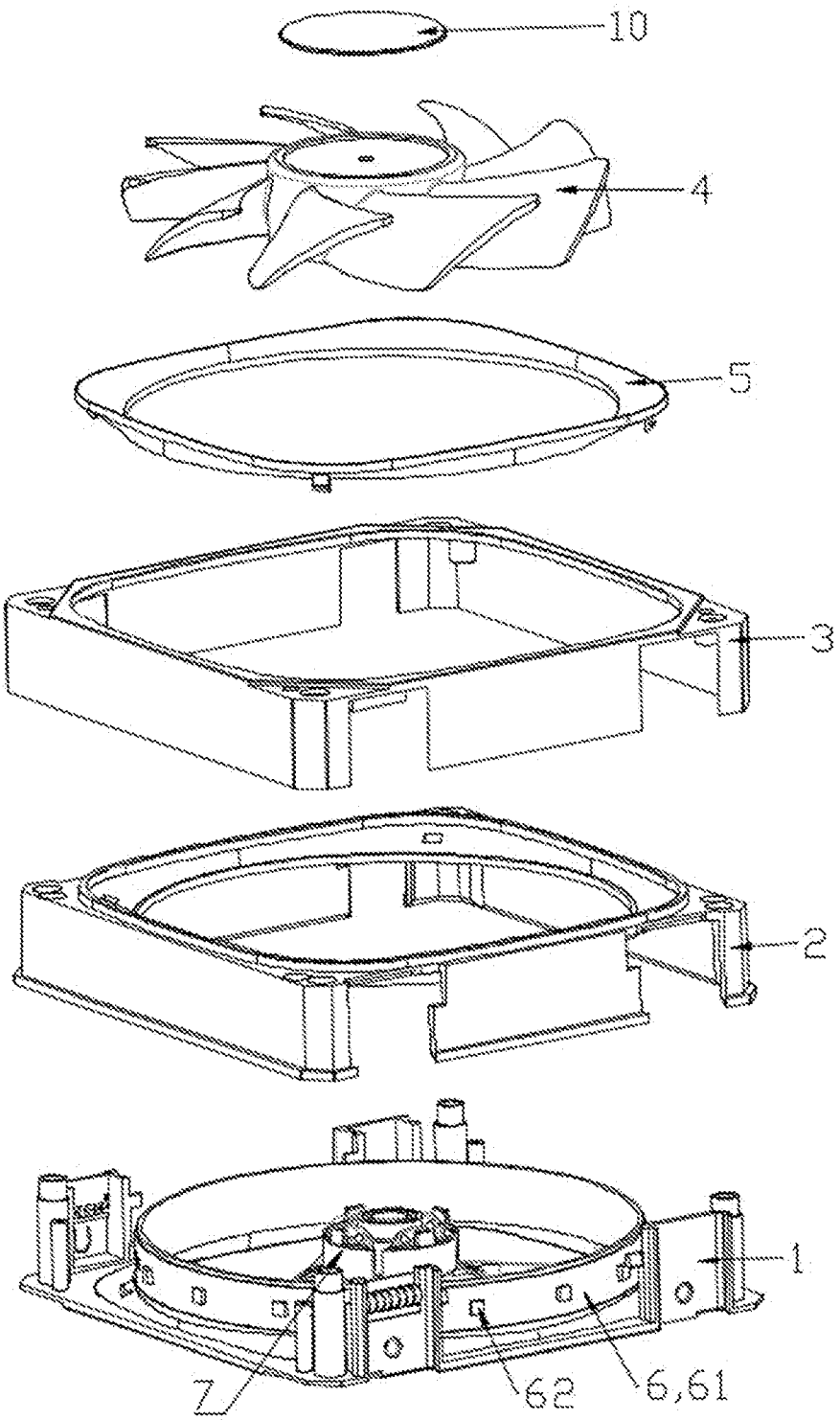
FIG. 2 is a schematic diagram of exploded structure of the fan with multiple light rings according to the present disclosure.
Figure 3:
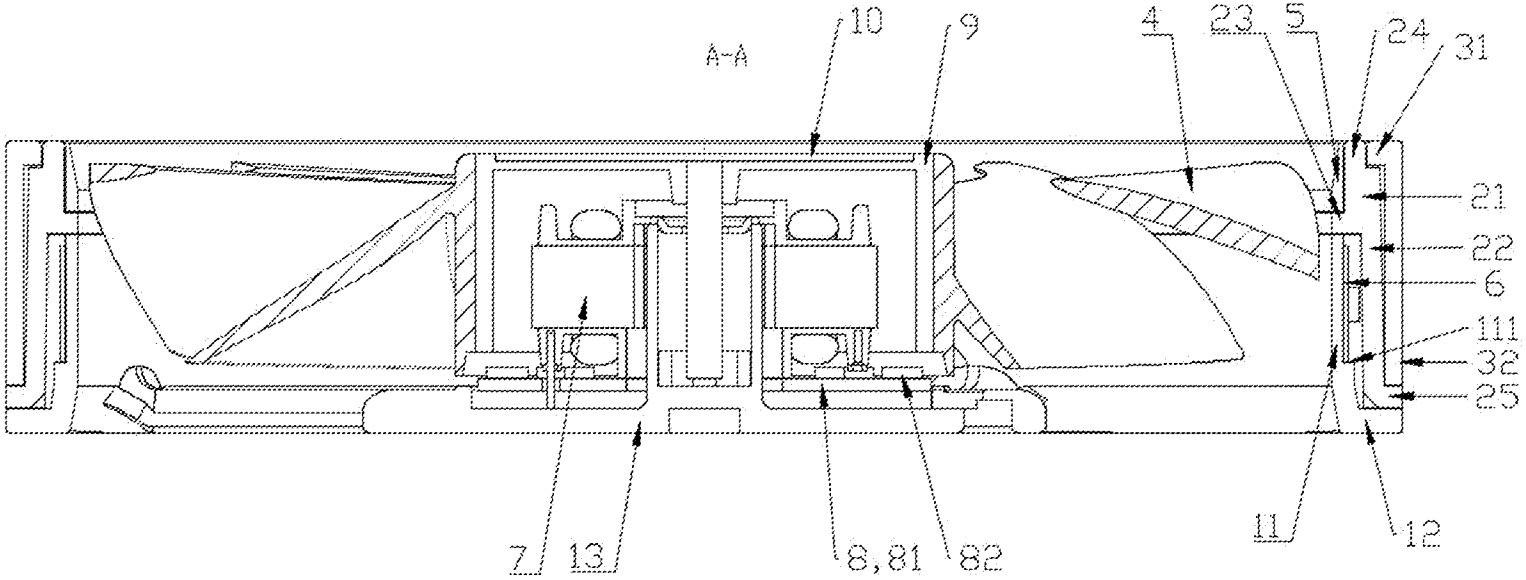
FIG. 3 is a schematic diagram of the A-A section structure in FIG. 1.

As shown in FIG. 1 to FIG. 3, a fan with multiple light rings according to the present disclosure comprises a lower fan frame cover 1, a light guide frame 2, an upper fan frame cover 3, fan blades 4, a shading cover 5 and an outer light source ring 6. The lower fan frame cover 1 comprises a first vertical portion 11, a first horizontal portion 12 and a central mounting seat 13 located inside the first vertical portion 11. The fan blades 4 are disposed on the central mounting seat 13. The light guide frame 2 comprises an upper horizontal portion 21 and a second vertical portion 22 disposed on an outer side of the upper horizontal portion 21. An inner light guide portion 23 is disposed on an inner side of the upper horizontal portion 21. An upper light guide portion 24 is disposed on an upper side of the upper horizontal portion 21. An outer light guide portion 25 is disposed at a lower end of the second vertical portion 22. The second vertical portion 22 is disposed outside the first vertical portion 11. The inner light guide portion 23 abuts on an upper end of the first vertical portion 11. The shading cover 5 abuts with a portion between the inner light guide portion 23 and the upper light guide portion 24, and the outer light guide portion 25 abuts on an upper surface of the first horizontal portion 12.

The upper fan frame cover 3 comprises a second horizontal portion 31 and a third vertical portion 32. The second horizontal portion 31 abuts with a portion between the upper light guide portion 24 and the upper horizontal portion 21. The third vertical portion 32 is disposed outside the second vertical portion 22, and a lower end of the third vertical portion 32 abuts on an upper surface of the outer light guide portion 25. The outer light source ring 6 is disposed between the lower fan frame cover 1 and the light guide frame 2, and the lower fan frame cover 1, the light guide frame 2 and the upper fan frame cover 3 fit together to form three light rings.

Specifically, as shown in FIGS. 1-2, the outer contour of the projection of the lower fan frame cover 1, the light guide frame 2, and the upper fan frame cover 3 in the horizontal direction is square, therefore the structure of the three components will appear different at different positions. Of course, they can also be round, which is not limited. In addition, the lower fan frame cover 1 and the upper cover 3 are made of plastic, and both are integrally molded, respectively. Light guide frame 2 is made of translucent plastic with light guide powder, specifically, it can be PC material. The components of light guide frame 2 can also be prepared by integral molding. For the square lower fan frame cover 1, the light guide frame 2, and upper fan frame cover 3, these three components can be assembled together using screws by means of screw mounting posts disposed at the four corners of the lower fan frame cover 1 and upper fan frame cover 3, and the through hole disposed in the light guide frame 2, but not limited to this.

Since the outer contour of the projection of the light guide frame 2 in the horizontal direction in the present embodiment is square, therefore, the structure of the light guide frame 2 at different positions has certain differences. Specifically, as shown in FIG. 3, the inner light guide portion 23 is set horizontally. Of course, the inner light guide portion 23 at the four corners of the square may also be set obliquely, and there is no limit to this.

The side of the inner light guide portion 23 towards the inside the lower fan frame cover 1 forms an inward inner light ring 231, the upper light guide portion 24 forms an upward upper light ring 241, and the side of the outer light guide portion 25 towards the outside of the lower fan frame cover 1 forms an outward outer light ring 251. Thereby, by means of the setting of the specific structure of the lower fan frame cover 1, the light guide frame 2 and the upper fan frame cover 3, with the shading cover 5 and the outer light source ring 6, use a light guide frame 2 to guide the light emitted by the outer light source ring 6, which can form three light rings on the inner side, outer side and upper side of the fan frame, so as to obtain the luminous effect of multiple light rings, so that the luminous effect of the fan is more attractive, and the structure is simple.

Further, a motor 7 and a central light source ring 8 are disposed on the upper surface of the central mounting seat 13. An output shaft of the motor 7 is connected with a light guide cover 9, and the light guide cover 9 covers the motor 7 and the central light source ring 8. At least part of the upper surface of the light guide cover 9 is covered by a nameplate 10, and the fan blades 4 are disposed around the light guide cover 9.

It is understandable that the output shaft of the motor 7 can drive the light guide cover 9 to rotate, and then drive the fan blades 4 to rotate. Specifically, the motor 7 is disposed on the upper side of the central light source ring 8, and the motor 7 does not block the light-emitting portion of the central light source ring 8, thereby allowing the light emitted by the central light source ring 8 to illuminate the light guide cover 9. On the one hand, the light guide cover 9 is used to protect the motor 7 and the central light source ring 8, on the other hand, it can be used to guide the light emitted by the central light source ring 8. Further, the nameplate 10 is preferably round, but not limited to this. Due to the arrangement of the nameplate 10 on the upper surface of the light guide 9, a central light ring 91 can be formed at the center of the fan. Therefore, four light rings can be formed on the fan.

Further, the central light source ring 8 comprises an annular substrate 81 and a plurality of first light sources 82 disposed on the annular substrate 81 at equal intervals.

Specifically, the first light source 82 herein may be an LED, but not limited to this. In order to obtain a better light guide effect, the annular substrate 81 is set horizontally, and multiple LED are evenly set along the circumference of the annular substrate 81, so that the illumination of the central light ring 91 is more uniform.

Further, the outer light source ring 6 comprises an annular strip 61 and a plurality of second light sources 62 disposed on the annular strip 61 at equal intervals.

Specifically, the second light source 62 herein may be an LED, but not limited to this. The annular strip 61 is set vertically, and multiple LED are evenly set along the circumference of the annular strip 61, so that the illumination of three light rings on the inner side, outer side and upper side can be realized by using only one outer light source ring 6, and the illumination is more uniform.

Further, a support portion 111 for supporting the outer light source ring 6 is disposed on an outer side of the first vertical portion 11.

During use, due to the rotation of the fan or external vibration, the position of the outer light source ring 6 is easy to shift, thereby affecting the luminous effect of the fan. Hence it is necessary to support and position the outer light source ring 6. Therefore, the first vertical portion 11 is provided with a support portion 111 on the outer side for supporting the outer light source ring 6, in order to resist the lower end of the annular strip 61 of the outer light source ring 6.

Further, the shading cover 5 is fixed to the inner light guide portion 23 by means of snap fit.

The snap fit connection can be removed. In the present embodiment, a snap is disposed on the lower surface of the shading cover 5 (not shown), and a slot is disposed in the inner light guide portion 23 (not shown). The shading cover 5 is fixed to the inner light guide portion 23 by snap fit, so that it is convenient to dispose the shading cover 5 on the inner light guide portion 23 or remove it from the inner light guide portion 23.

A fan with multiple light rings according to the present disclosure, by means of the setting of the specific structure of the lower fan frame cover 1, the light guide frame 2 and the upper fan frame cover 3, with the shading cover 5 and the outer light source ring 6, use a light guide frame 2 to guide the light emitted by the outer light source ring 6, which can form three light rings on the inner side, outer side and upper side of the fan frame, so as to obtain the luminous effect of multiple light rings, so that the luminous effect of the fan is more attractive, and the structure is simple and the assembly is convenient.

The technical features of the embodiments described above may be arbitrarily combined, and for the sake of conciseness, not all possible combinations of the technical features in the above embodiments are described. However, as long as there is no contradiction in the combination of these technical features, they should be considered to be within the scope of the present description.

The above embodiments only express several embodiments of the present disclosure, and their description is more specific and detailed, but it cannot be understood as a limitation on the scope of the disclosure. It should be noted that for those of ordinary skill in the art, without departing from the principles of the present disclosure, certain modifications and improvements may also be made, and these also fall within the scope of protection of the present disclosure. Therefore, the scope of protection of this disclosure shall be subject to the attached claims.

The technical features of the embodiments described above may be arbitrarily combined, and for the sake of conciseness, not all possible combinations of the technical features in the above embodiments are described. However, as long as there is no contradiction in the combination of these technical features, they should be considered to be within the scope of the present description.

The above embodiments only express several embodiments of the present disclosure, and their description is more specific and detailed, but it cannot be understood as a limitation on the scope of the disclosure. It should be noted that for those of ordinary skill in the art, without departing from the principles of the present disclosure, certain modifications and improvements may also be made, and these also fall within the scope of protection of the present disclosure. Therefore, the scope of protection of this disclosure shall be subject to the attached claims.

What is claimed is:

1. A fan with multiple light rings, comprising: a lower fan frame cover, a light guide frame, an upper fan frame cover, fan blades, a shading cover and an outer light source ring wherein:

the lower fan frame cover comprising a first vertical portion, a first horizontal portion, and a central mounting seat located inside the first vertical portion, the fan blades being disposed on the central mounting seat;

the light guide frame comprising an upper horizontal portion and a second vertical portion disposed on an outer side of the upper horizontal portion, an inner light guide portion being disposed on an inner side of the upper horizontal portion, an upper light guide portion being disposed on an upper side of the upper horizontal portion, an outer light guide portion being disposed at a lower end of the second vertical portion, the second vertical portion being disposed outside the first vertical portion, the inner light guide portion abutting on an upper end of the first vertical portion, the shading cover abutting with a portion between the inner light guide portion and the upper light guide portion, and the outer light guide portion abutting on an upper surface of the first horizontal portion;

the upper fan frame cover comprising a second horizontal portion and a third vertical portion, the second horizontal portion abutting with a portion between the upper light guide portion and the upper horizontal portion, the third vertical portion being disposed outside the second vertical portion, and a lower end of the third vertical portion abutting on an upper surface of the outer light guide portion;

the outer light source ring being disposed between the lower fan frame cover and the light guide frame, and the lower fan frame cover, the light guide frame and the upper fan frame cover fit together to form three light rings.

2. The fan with multiple light rings according to claim 1, wherein a motor and a central light source ring are disposed on an upper surface of the central mounting seat; an output shaft of the motor is connected with a light guide cover, and the light guide cover covers the motor and the central light source ring; at least part of an upper surface of the light guide cover is covered by a nameplate; and the fan blades are disposed around the light guide cover.

3. The fan with multiple light rings according to claim 2, wherein the central light source ring comprises an annular substrate and a plurality of first light sources disposed on the annular substrate at equal intervals.

4. The fan with multiple light rings according to claim 1, wherein the outer light source ring comprises an annular strip and a plurality of second light sources disposed on the annular strip at equal intervals.

5. The fan with multiple light rings according to claim 1, wherein a support portion for supporting the outer light source ring is disposed on an outer side of the first vertical portion.

6. The fan with multiple light rings according to claim 1, wherein the shading cover is fixed to the inner light guide portion by means of snap fit.

* * * * *